US005549355A

United States Patent [19]

Illulian

[11] Patent Number: 5,549,355

[45] Date of Patent: Aug. 27, 1996

[54] FITTED FURNITURE COVER

[76] Inventor: Khosro Illulian, 315 N. Maple Dr., Beverly Hills, Calif. 90210

[21] Appl. No.: 457,828

[22] Filed: Jun. 1, 1995

Related U.S. Application Data

[63] Continuation of Ser. No. 181,819, Jan. 18, 1994, abandoned.

[51] Int. Cl.[6] ..... A47C 27/00

[52] U.S. Cl. ..... 297/224; 297/225; 297/228.1; 297/228.12; 297/229

[58] Field of Search ..... 297/224, 228.11, 297/228.12, 219.1, 225, 218.1, 218.4, 218.5, 228.1, 229

[56] References Cited

U.S. PATENT DOCUMENTS 1,825,909 10/1931 Levi .
2,183,828 12/1939 Trubitz .
2,367,450 1/1945 Trubitz .
2,667,211 1/1954 Krasnov et al. .
2,793,683 5/1957 Trubbitt .
4,838,610 6/1989 Perrin .

*Primary Examiner*—Milton Nelson, Jr.
*Attorney, Agent, or Firm*—Notaro & Michalos P.C.

[57] ABSTRACT

A furniture slipcover having an elastic band stitched at selected positions along the inside of the cover such that when the cover is placed on a furniture piece, such as a sofa or chair, the cover takes the shape of the furniture piece, thus eliminating the time consuming and expensive steps which are currently required to fit a cover to the furniture piece. Elastic bands are also provided which enable the cover to be gathered at desired portions such that the cover has a fitted and shaped look. A plurality of elastic ties are formed on the inside of the cover and are used to secure the cover to the furniture piece by tieing it around the furniture seat cushions.

3 Claims, 3 Drawing Sheets

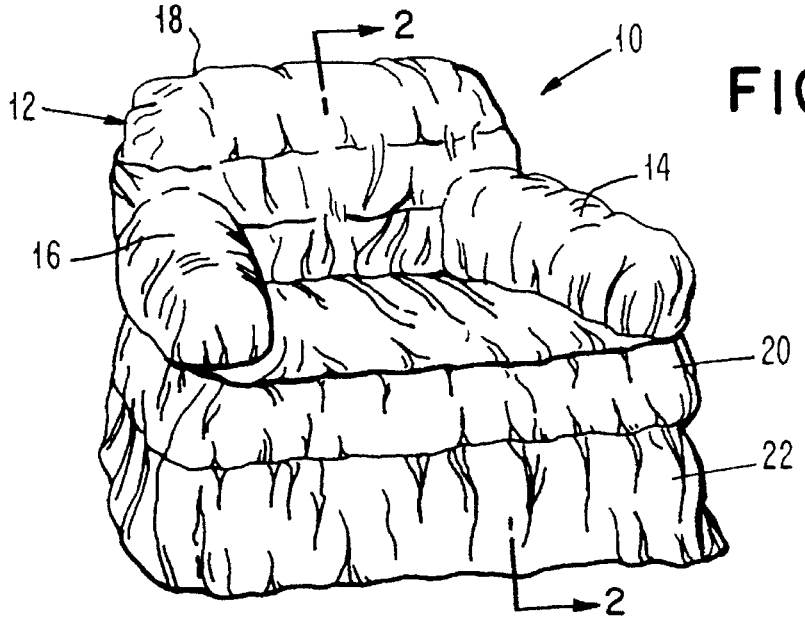
FIG. 1
FIG. 3
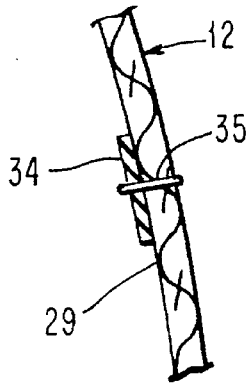
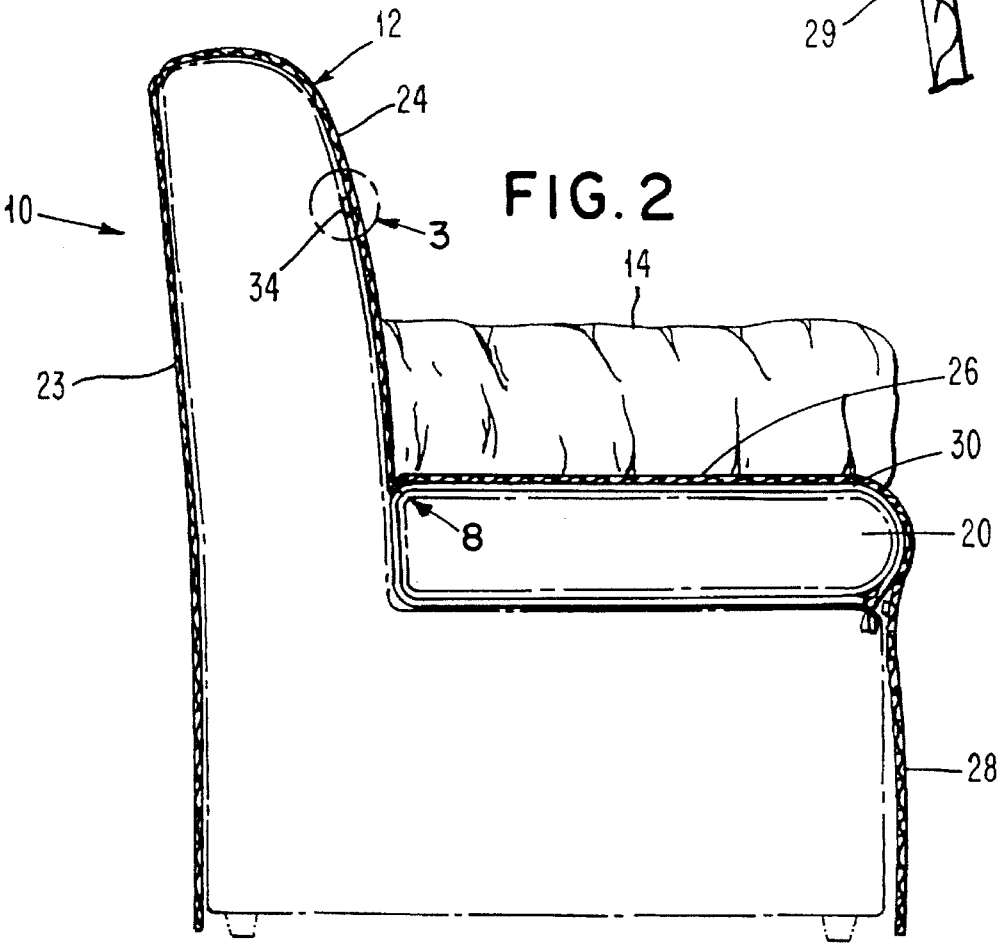
FIG. 2

FIG. 4
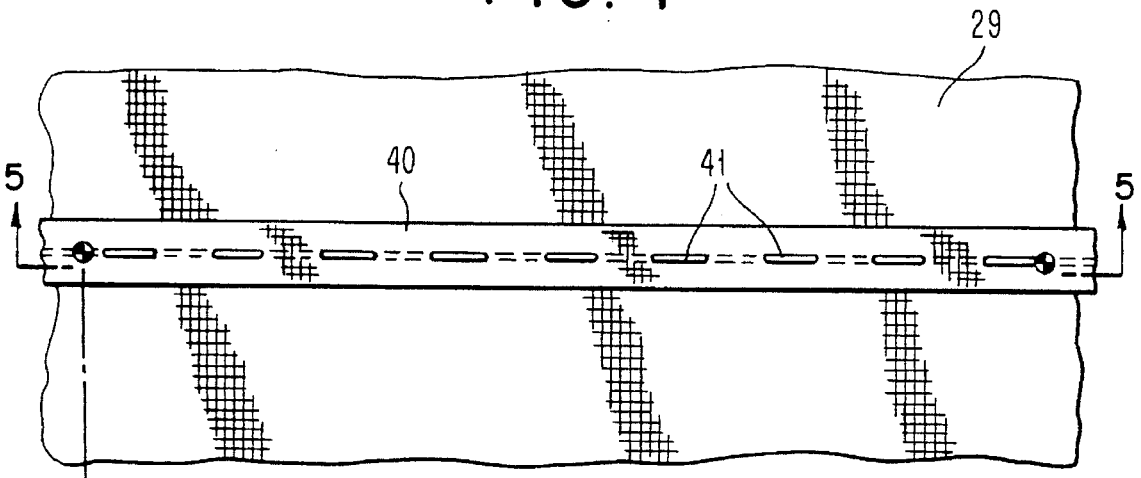
FIG. 5
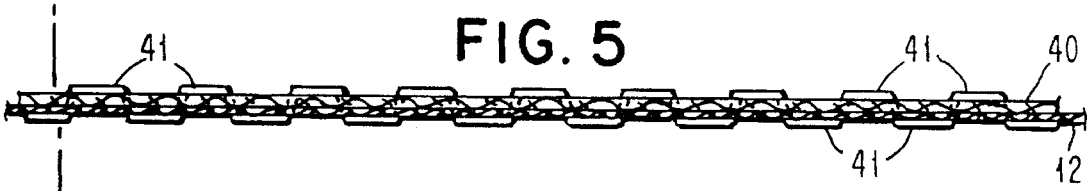
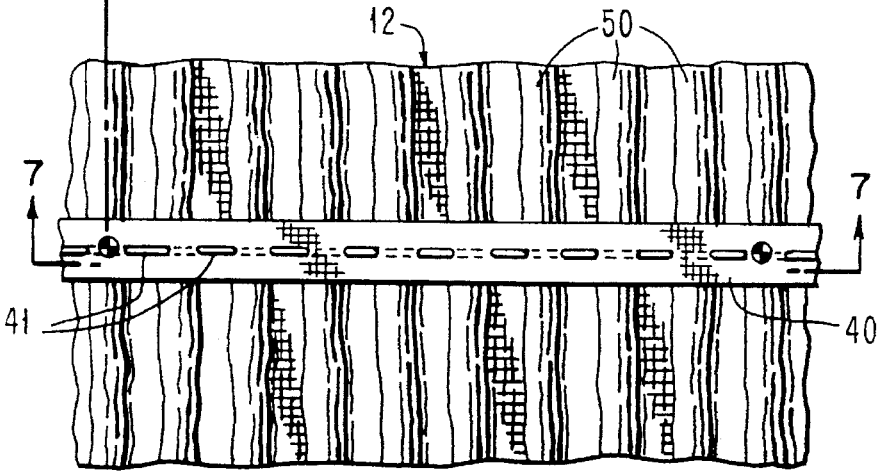
FIG.6
FIG. 7
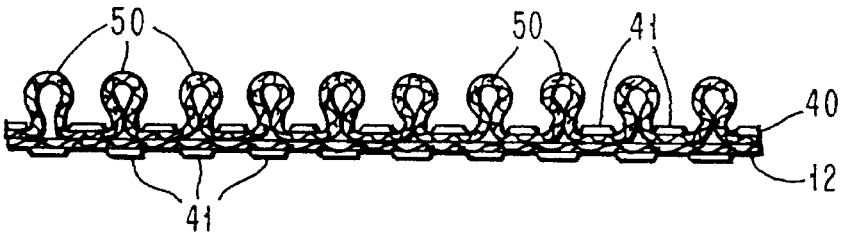

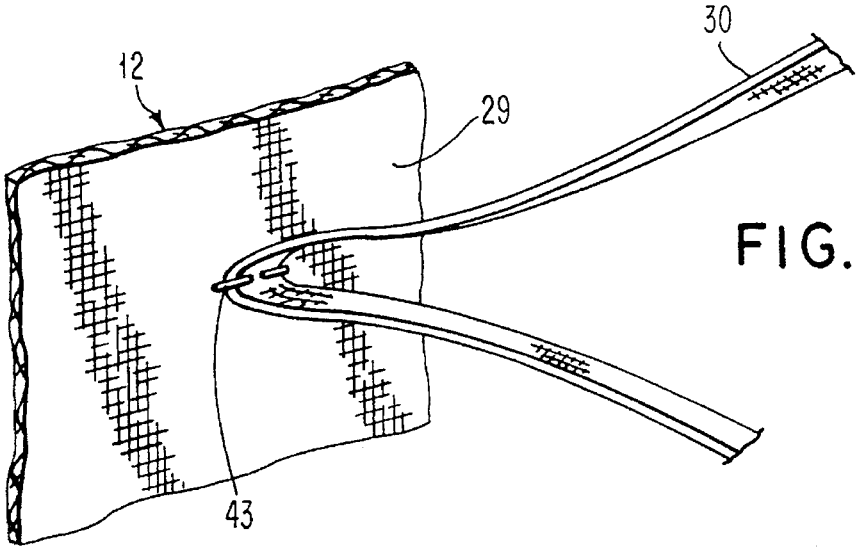
FIG. 8
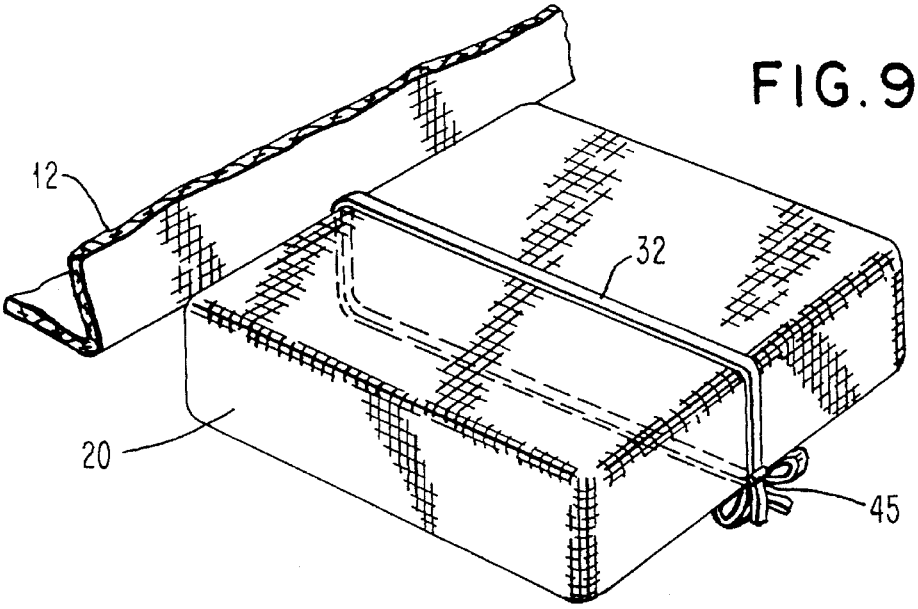
FIG. 9
FIG. 10
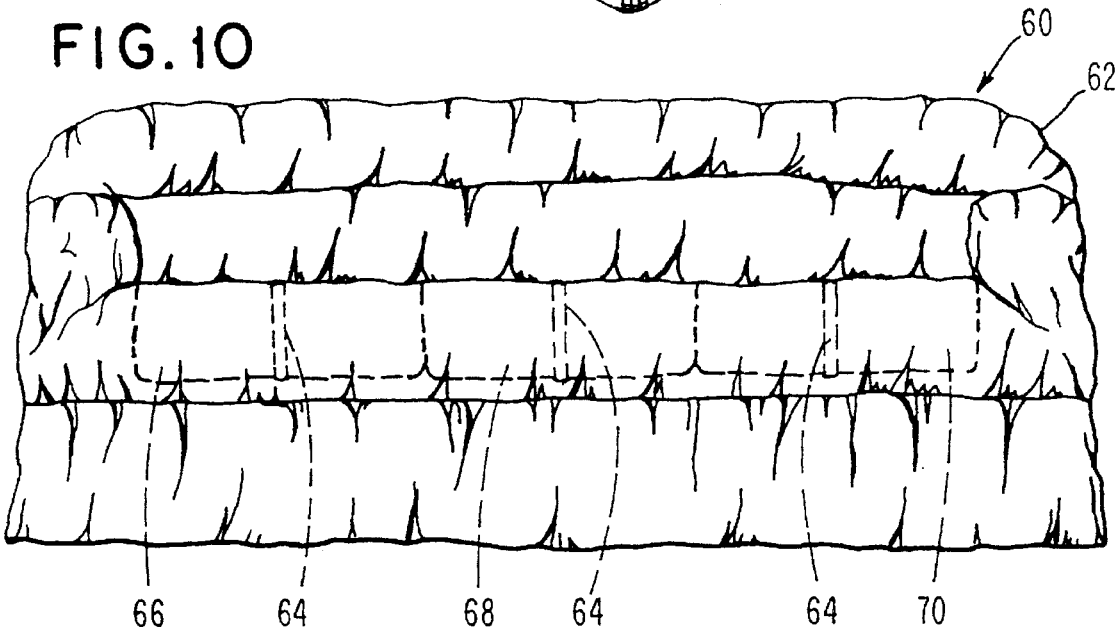

FITTED FURNITURE COVER

This application is a continuation of application Ser. No. 08/181,819 filed Jan. 18, 1994, and now abandoned.

BACKGROUND OF THE INVENTION

1. Field of the Invention

The present invention relates to fabric slipcovers covering furniture pieces wherein a single sized cover can be utilized for most of the pieces of a specific furniture style.

2. Description of the Prior Art

The standard practice for covering various pieces of furniture is to have a designer order a specific fabric for the furniture piece and than to have skilled workers fit the fabric to the furniture piece.

This procedure is very labor intensive and is a significant factor in the overall cost of having furniture pieces fitted with fabric. In addition, if the owner of the furniture piece desires to buy a different piece of furniture of the same style, the fitted cover of the older piece cannot be utilized, for the most part, for the newer piece, particularly if the newer piece is larger in length than the older piece. In either case, the labor extensive fitting procedure described above would still be required.

It is therefore desired to provide a fabric cover which is adapted to fit most furniture pieces of a particular style without requiring the labor intensive fitting techniques of the prior art.

SUMMARY OF THE PRESENT INVENTION

The present invention provides a furniture cover which is designed such that it provides a fitted look for most of the furniture pieces of a particular style. The fabric from which the cover is made has a plurality of elastic bands stitched to the inside of the fabric cover. The elastic bands are stitched to particular areas around the inside periphery of the cover such that the elastic provides an inwardly directed force when the cover is placed upon the furniture piece, the force pulling the fabric cover close against the underlying furniture piece. In addition, elastic ties are stitched on the inside of the fabric cover and extends around some, or all, of the furniture seat cushions to secure the cover to the furniture piece. Finally, elastic bands are stitched to the inside of the cover at desired locations such that when the cover is fitted on the furniture piece, the non-stretched portions of the elastic bands cause the fabric attached thereto to gather or form ruffles The present invention thus provides a furniture cover which is designed to fit most pieces in a particular style and size of furniture and which can be easily installed by the purchaser. The cover also gathers or forms ruffles at predetermined positions on the fitted cover, allowing a stylish appearance.

Thus, the present invention provides a furniture cover which is simple to install, is relatively inexpensive and which can be reused to cover other furniture pieces of the same style if the user desires to do so.

DESCRIPTION OF THE DRAWING

For a better understanding of the invention as well as other objects and further features thereof, reference is made to the following description which is to be read in conjunction with the accompanying drawings wherein:

FIG. 1 illustrates the fabric slipcover of the present invention fitted over a chair;

FIG. 2 is a sectional view along line 2—2 of FIG. 1;

FIG. 3 is a detail showing an elastic band stitched to the rear surface of the cover;

FIG. 4 shows the elastic band stretched on the rear surface of the cover;

FIG. 5 is a sectional view along line 5—5 of FIG. 4;

FIG. 6 illustrates the elastic band of FIG. 4 shown in a relaxed position such that the fabric cover is gathered;

FIG. 7 is a sectional view along line 7—7 of FIG. 6;

FIG. 8 shows an elastic tie attached to the rear surface of the cover;

FIG. 9 shows the elastic tie of FIG. 8 tied around a furniture cushion; and FIG. 10 illustrates a sofa covered by the cover of the present invention with three cushion ties illustrated in phantom.

DESCRIPTION OF THE INVENTION

Referring now to FIG. 1, a chair 10 is illustrated fitted with the fabric slipcover 12 of the present invention. Chair 10 has arm rests 14 and 16, back 18 and cushion, or seat, 20. A portion 22 of cover 12 forms a dust ruffle for chair 10. FIG. 2 is a cross-sectional view along line 2—2 of FIG. 1 and shows arm rest 14, seat cushion 20 and cover 12. As illustrated, cover 12 comprises portion 23 which extends in an essentially vertical direction to cover the back of the chair 10, a portion 24 which comes up over the front portion thereof to cover arms 14 and 16, a portion 26 which covers the seat 20 and a portion 28 which extends downward in the vertical direction to form the dust ruffle 22. An elastic band 30 is attached to the inner or rear surface of fabric 12 at the position illustrated and tied about cushion 20 to secure cover 12 to the furniture piece 10.

As shown more clearly in the detail of FIG. 3, cover 12 has an elastic band 34 secured on the inner surface 29 of cover 12, at a predetermined position by stitching (only a single stitch 35 is illustrated in the figure).

Referring now to FIG. 4, an elastic band 40 is illustrated as stretched and stitched to the inner surface 29 of cover 12 and FIG. 5 is a cross-sectional view along line 5—5 of FIG. 4 showing the elastic band 40 stitched to the cover 12 via a plurality of stitches 41.

FIG. 6 shows the elastic band 40 of FIG. 4 in a relaxed position which in turn causes the cover 12 to gather along that portion of the cover 12 which has the stretched elastic material stitched thereto.

FIG. 7 is a cross-sectional view along line 7—7 of FIG. 6 and shows a plurality of folds 50 in fabric 12 formed on the front surface of cover 12, providing a stylish gathering effect to the observer.

FIG. 8 is a view illustrating a portion of cover 12 showing elastic tie 30 attached to the inner surface 29 thereof by stitch 43. FIG. 9 shows a portion of cover 12 folded in a manner such that elastic tie 30 can be positioned around cushion 20 and tied at 45 to secure the cover 12 to the furniture piece 10. Preferably, the number of elastic ties provided corresponds to the number of furniture cushions. In the case of furniture piece 10, a single elastic tie is utilized (in the sofa 60 shown in FIG. 10, three elastic ties are provided as will be described hereinafter).

FIG. 10 illustrates another style 60 of a furniture piece with which the fitted cover of the present invention can be utilized. Piece 60, which is a three cushion sofa, has a cover 62, with a plurality of elastic bands sewn on the inside surface thereof to provide the fitted cover effect, stretched elastic bands to provide the gathering effect and also a plurality of elastic ties to secure the fitted cover 62 to the sofa 60, in an identical manner described with reference to the covering of piece 10. As illustrated in phantom in FIG. 10, three ties 64 are utilized to secure the cover 62 to the three sofa cushions 66, 68 and 70.

The number and position of the elastic bands are selected on the basis of fit, whereby the elastic bands stretch and/or pull the fabric to conform and adjust to various sizes of sofas and chairs as to the respective width, depth, size of arm and height, so that one size can cover a multitude of sofa and chair sizes and styles. In addition, the number of elastic bands are selected on the basis of wearability, fashion and desired ruffling effect. The increase in the number of elastic bands allows more maneuverability in different parts of the sofa and/or chair, and for the fabric to adjust to the respective shares of arms, backs and height. The decrease in number of elastic bands would allow for less ruffling and maneuverability.

It should be noted that the fitted cover described hereinabove with reference to furniture pieces 10 and 60 can be adapted for use with many other styles of furniture.

The slipcover of the present invention is installed as follows:

1. The slipcover is first placed on the back of the sofa or chair with the elastic tie positioned in front of the furniture piece. The elastic is then tied underneath the cushion;
2. The cover is tucked into the space between the seat and back and between the arms and seats of the furniture piece; and
3. The cover is pulled down around the furniture piece. The cover will stretch to give the appearance of a ruffle or may be tucked in to just touch the floor.

The present invention thus provides a fitted and styled cover which can be simply installed by a purchaser and avoids the expense of the prior art, custom fitted covers.

While the invention has been described with a reference to its preferred embodiment, it will be understood by those skilled in the art that various changes may be made and equivalents may be substituted for elements thereof without departing from the true spirit and scope of the invention. In addition, modifications may be made to adapt a particular situation or material to the teachings of the invention without departing from its essential teachings.

What is claimed is:

1. A one piece ready-made furniture slip cover (12) for covering substantially all of a piece of furniture (10), the piece of furniture having a back (18), at least one arm rest (16), a seat (20) and a body, the slip cover comprising:

a back portion (23, 24) for covering the furniture back, the back portion having an inner surface for facing the furniture back, and an outer surface for facing away from the furniture back;

a seat portion (26) connected to the back portion, for covering the furniture seat;

an arm rest portion connected to the back and seat portions, for covering the arm rest;

a body portion (28) connected to the back, seat and arm rest portions, for covering the furniture body, the body portion having an inner surface for facing the furniture body, and an outer surface for facing away from the furniture body;

at least one first elastic band (34) sewn onto and across the inner surface of the back portion for elastically fitting the back portion of the slipcover to the furniture back; and a second elastic band (40) sewn onto and around the inner surface of the body portion by a plurality of spaced apart stitches (41), portions of the second elastic band between adjacent stitches being relaxed after having been stretched while the spaced stitches were made so that the slipcover includes a plurality of folds (50) in the body portion of the slipcover, which form a ruffle in the body portion, each fold being between a pair of adjacent stitches.

2. A slipcover according to claim 1, including at least one elastic tie (30) sewn at one location (43) along a length of the elastic tie, to the inner surface of the back portion at a location in the back portion that is near the seat portion, for tying (45) the slipcover to a portion of the piece of furniture.

3. A slipcover according to claim 2, wherein the piece of furniture has a plurality of cushions in the furniture seat, the slipcover including a plurality of said elastic ties (32) which are equal in number to the number of cushions, each tie being positioned on the inner surface of the back portion and having a length so as to tie around one of the cushions.

* * * * *